US005897394A

United States Patent [19]

Adachi

[11] Patent Number: 5,897,394

[45] Date of Patent: Apr. 27, 1999

[54] CONDUCTOR CONNECTION TERMINAL AND METHOD OF CONNECTION

[75] Inventor: Ryoichi Adachi, Tokyo, Japan

[73] Assignee: The Furukawa Electric Co., Ltd., Tokyo, Japan

[21] Appl. No.: 08/770,798

[22] Filed: Dec. 20, 1996

[30] Foreign Application Priority Data

Dec. 22, 1995 [JP] Japan ..... 7-334889

[51] Int. Cl.[6] ..... H01R 23/66

[52] U.S. Cl. ..... 439/496; 439/857

[58] Field of Search ..... 439/393, 492, 439/495, 496, 856, 857

[56] References Cited

U.S. PATENT DOCUMENTS

| | | | |
|---|---|---|---|
| 3,656,093 | 4/1972 | Kinkaid | 439/636 |
| 3,696,319 | 10/1972 | Olsson | 439/496 |
| 5,308,262 | 5/1994 | Chishima | 439/495 |

FOREIGN PATENT DOCUMENTS

| | | | |
|---|---|---|---|
| 0 601 577 A2 | 6/1994 | European Pat. Off. . | |
| 0 601 577 A3 | 6/1994 | European Pat. Off. . | |
| 39 15 611 | 6/1990 | Germany . | |
| 41 08 066 C1 | 2/1992 | Germany . | |
| 2623205 | 12/1997 | Germany . | |
| 1522029 | 8/1978 | United Kingdom | 439/496 |

*Primary Examiner*—Neil Abrams

*Attorney, Agent, or Firm*—Armstrong, Westerman, Hattori, McLeland & Naughton

[57] ABSTRACT

A flat cable connection terminal giving stable connection terminal giving stable connection with a conductor (2) in a flat cable (1). The connection terminal (30) has a fork (31). The fork (31) has flat prongs (34) of a thickness equal to or somewhat smaller than the width of the conductor (2) and thick portions (32) projecting partially out from the flat prongs and of a thickness for fitting in the groove (14) of the terminal holder. The thick portions (32) are disposed to closely fit between partitions (12) to laterally stabilize the connections. The prongs (34) are formed thinner toward the frontmost ends. Further, the frontmost ends (33) of the prongs (34) facing each other across the (c) comprising the fork (31) have inclinations **(33*a*) at the sides facing each other across the slot (c) so as to facilitate insertion over the bent back conductor (2). The front ends (33) of the prongs (34)** facing each other across the slot (c) comprising the fork are formed in wedge shapes so as to partially press against the conductor.

13 Claims, 5 Drawing Sheets

CONDUCTOR CONNECTION TERMINAL AND METHOD OF CONNECTION

BACKGROUND OF THE INVENTION

1. Field of the Invention

The present invention relates to a conductor connection terminal for connecting with a conductor of a cable and to a method of connection using the connection terminal to connect to a conductor. More specifically, the present invention relates to a conductor connection terminal for connecting with a conductor accommodated in a groove of a terminal holder and bent 180° at the end of the terminal holder by gripping it from the two sides, and a method of connection thereof.

2. Description of the Related Art

A description will first be given of the method of connecting a flat cable in the related art with reference to FIGS. 1A to 1C for background for the explanation of the method of connection of a conductor connection terminal of the present invention.

A flat cable 1 Illustrated in FIG. 1A, a terminal holder 10 illustrated in FIG. 1B, and at least one flat cable connection terminal 20 partially illustrated in FIG. 1C are prepared.

The flat cable 1 is comprised of a plurality of conductors (wires) 2 arranged horizontally at equal intervals and covered by an insulator 5. The adjoining conductors 2, 2 define slits 3 therebetween. Normally, the conductors 2 are flat In shape.

The terminal holder 10 has side walls 11, 11 at its two sides and is provided with U-shaped partitions 12 at intervals substantially corresponding to the width (thickness) of the conductors 2 in the flat cable 1. Grooves 14 are defined between the adjoining partitions 12, 12 or the adjoining side walls 11 and partitions 12. Since the conductors 2 are to be accommodated in these grooves 14, the width of the grooves 14 is made somewhat larger than the width (thickness) of the conductors 2. The thickness of the partitions 12 is made somewhat smaller than the width of the slits 3 so that the slits 3 of the flat cable 1 will fit over the partitions 12.

Each of the flat cable connection terminals 20 has a fork 21 made of a conductive metal and having two prongs 24, 24 facing each other across a slot 25 for gripping a conductor 2. The "fork" is so named since the two prongs 24, 24 form the tines of a fork.

Next, the insulator 5 at the portion (end connection portion) 4 for connection near the end of the flat cable 1 is removed and the conductors 3 to be connected to flat cable connection terminals 20 are partially exposed.

Further, as illustrated in FIG. 1B and FIG. 1C, the exposed conductors 2 of the flat cable 1 are inserted into the grooves 14 of the terminal holder 10 while fitting the slits 3 over the partitions 12, then the flat cable 1 is bent back 180° at the end of the terminal holder 10.

The two sides of the conductors 2 inserted in the grooves 14 between the adjoining partitions 12, 12 of the terminal holder 10 or the adjoining side walls 11 and partitions 12 and bent back 180° are gripped by the forks 21 of the flat cable connection terminals 20 to connect the conductors 2 of the flat cable 1 and the flat cable connection terminals 20.

Note that at the opposite sides of the forks 21 of the flat cable connection terminals 20 are connected conductors (not shown) which are connected to an electrical apparatus (not shown).

However, the above-mentioned method of connection of the flat cable 1 and the connection terminals 20 has the following problems.

The connection terminals 20 are produced by a simple operation of punching them from a single conductive metal sheet, Normally, the thickness of the forks 21 is smaller than the width of the grooves 14 of the terminal holder 10 in which the conductors 2 are accommodated. Therefore, the forks 21 can move considerably freely between the adjoining partitions 12, 12 of the terminal holder 10. The conductors 2 are connected merely by the opposing prongs 24, 24 of the forks 21. However, since the forks 21 are made of thin sheet metal, the gripping force is insufficient. Accordingly, poor contact is apt to occur due to vibration etc. or, when a pullout force is applied to the forks 21, the forks 21 will easily detach from the conductors 2.

As explained above, if the connections between the conductors 2 and forks 21 are not stable, this will lead to poor contact etc. and an increase in the contact resistance.

In addition, since the state of contact is uncertain and the forks 21 can move freely within the grooves 14 of the terminal holder 10, it is difficult to perform the connection work reliably and uniformly.

The above was an example of use of a flat cable as the cable, but similar problems are encountered in connection terminals of conductor connector sockets of other cables connected using terminal holders.

SUMMARY OF THE INVENTION

An object of the present invention is to provide connection terminals which enable stable contact (connection) between the conductors and connection terminals and lowers the contact resistance.

Another object of the present invention is to provide a method of connection which is easy in terms of work and gives a stable contact (connection) between the conductors and connection terminals.

According to a first aspect of the present invention, there is provided a connection terminal having a connection portion for dripping the two sides of a conductor accommodated in a groove of a terminal holder and bent back at the end of the terminal holder so as to connect to the conductor, the connection portion provided with a fork comprised of two portions facing each other across a slot of a size equal to, or somewhat smaller than, the thickness of the beat back conductor so as to grip the two sides of the conductor bent back in the groove at the and of the terminal holder, and the fork having flat prongs of a thickness equal to, or somewhat smaller than, the width of the conductor, and thick portions partially projecting out from the flat prongs and having a thickness for insertion in the groove of the terminal holder.

Preferably, the prongs are formed thinly in an inclined fashion toward the frontmost ends of the side of gripping the conductor.

More preferably, the front ends of the prongs, comprising the fork facing each other across the slot have inclined surfaces facing each other across the slot.

More preferably, the front ends of the prongs, comprising the fork facing each other across the slot are formed in wedge shapes so as to partially press against the conductor then gripping it.

More preferably, the interval between the prongs, comprising the fork facing each other across the slot is formed slightly narrower than the thickness of the conductor bent back at the terminal holder.

Preferably the prongs, comprising the fork facing each other across the slot have elasticity at the sides facing each other across the slot.

More preferably, a portion for connection to a wire is provided at the side of the prongs opposite to the slot.

More specifically, the conductor is at least one conductor of a flat cable, comprised of a plurality of conductors arranged at predetermined intervals and covered with an insulator, from which part of the insulating covering has been removed to expose the same.

More specifically, the connection terminal is formed by bending a single sheet of conductive metal and has a thickness when bent which is substantially equal to, or somewhat thinner than, the thickness of the conductor. Preferably, projecting portions comprising the thick portions are formed on the single sheet of conductive metal.

More specifically, the connection terminal is formed by a single sheet of conductive metal and has a thickness when bent substantially equal to, or somewhat thinner than, the thickness of the conductor, Preferably, projecting portions, comprising the thick portions, are formed on the two sides of the single sheet of conductive metal. More preferably, the thickness of the thick portions of the prongs of the connection terminal is a thickness equal to the width of the groove of the terminal holder, or somewhat smaller than the width of the groove of the terminal holder.

According to a second aspect of the present invention, there is provided a connection terminal having a connection portion for gripping the two sides of a conductor accommodated in a groove of a terminal holder and bent back at the end of the terminal holder so as to connect to the conductor, the connector portion provided with a fork comprised of two prongs facing each other across a slot of a size equal to, or somewhat smaller than, the thickness of the bent back conductor so as to grip the two sides of the conductor bent back in the groove at the end of the terminal holder, the thickness of the prongs being formed somewhat smaller than the width or thickness of the conductor, the prongs each having wedge shaped projections at the sides facing each other across the slot, the interval between these projections being set somewhat smaller than the thickness of the conductor to be gripped, and the conductor being connected by the elasticity of the facing prongs.

According to a third aspect of the present invention, there is provided a method of connection of a flat cable comprised of a plurality of conductors arranged horizontally at predetermined intervals and covered with an insulator comprising removing part of the insulator to expose the conductors and form a connection portion, accommodating the exposed conductors of the connection portion of the flat cable in grooves of an insulating terminal holder having a plurality of partitions having widths corresponding to the intervals and grooves formed between the adjoining partitions with widths corresponding to the width (thickness) of the conductors of the flat cable, bending back the flat cable at the end of the terminal holder, and gripping the two sides of the conductors of the flat cable by forks of a flat cable connection terminals having forks comprised of pairs of conductive prongs formed so as to grip the two sides of the conductors of the flat cable accommodated bent back in the grooves of the terminal holder, wherein flat cable connection terminals with a thickness of the prongs which is partially a thickness corresponding to the width of the grooves of the terminal holder are used and the forks are fit over the two sides of the conductors of the flat cable.

BRIEF DESCRIPTION OF THE DRAWINGS

These and other objects and features of the present invention will become clearer from the following description given with reference to the attached drawings, in which.

DESCRIPTION OF THE PREFERRED EMBODIMENTS

Next, preferred embodiments of the connection terminals of the present Invention will be explained with reference to the attached drawings.

Figure 2A:
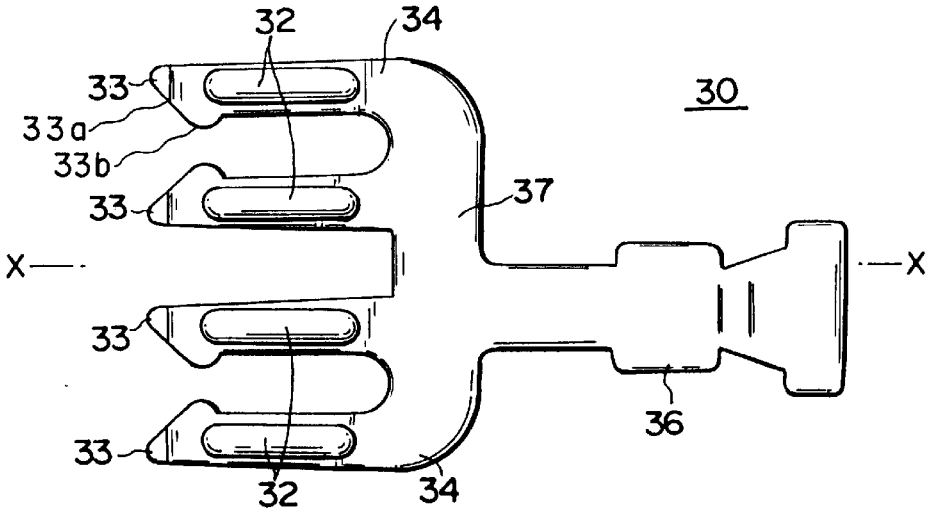
FIGS. 2A to 2C are a developed view, plan view, and side view of the flat cable connection terminal of a first embodiment of the present invention.
Figure 2B:
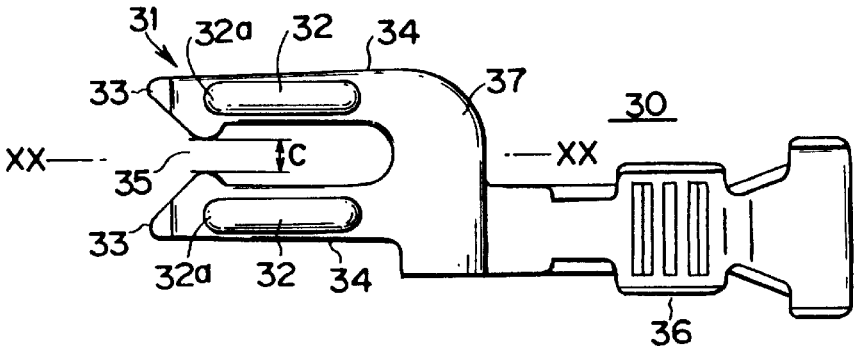
Figure 2C:
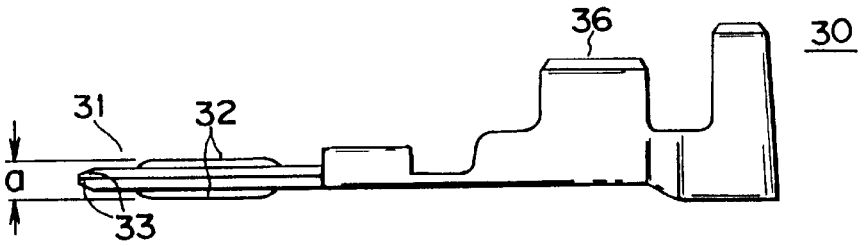

FIGS. 2A to 2C are a developed view plan view, and side view of a flat cable connection terminal of a first embodiment of the present invention.

The flat cable connection terminal 30, as illustrated in FIG. 2A, has a fork 31 comprised of four flat prongs (or branch portions) 34 made of a conductive metal connected by a base (or root) 37 and folded at the line X—X to overlie each other. As illustrated in FIG. 23, the two prongs 34, 34 facing each other across the centerline XX—XX of the slot 35 serving as the inlet for gripping a conductor 2 form the prongs of a fork. That is, a fork 31 is comprised of a slot 35 and two facing prongs 34, 34. A conductor 2 is gripped by the prongs 34, 34 of the fork 31 across the slot 35. At the opposite side of the fork 31 is provided a crimping portion 36. The crimping portion 36 crimps and connects a wire (not shown) connected to the object to be electrically connected with a conductor 2 of the flat cable 1, for example, an electrical apparatus (not shown).

Figure 3:
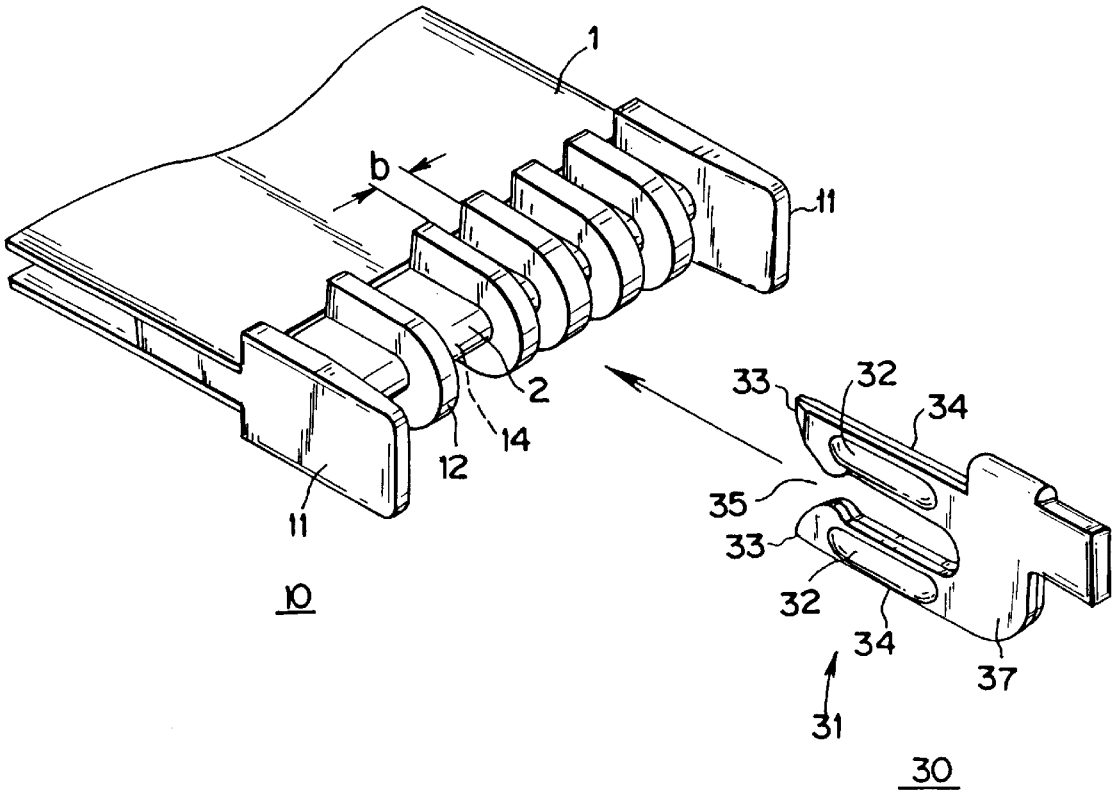
FIG. 3 is a perspective view of the state of connection of the flat cable connection terminal illustrated in FIGS. 2A to 2C to the terminal holder of the flat cable.
Figure 4A:
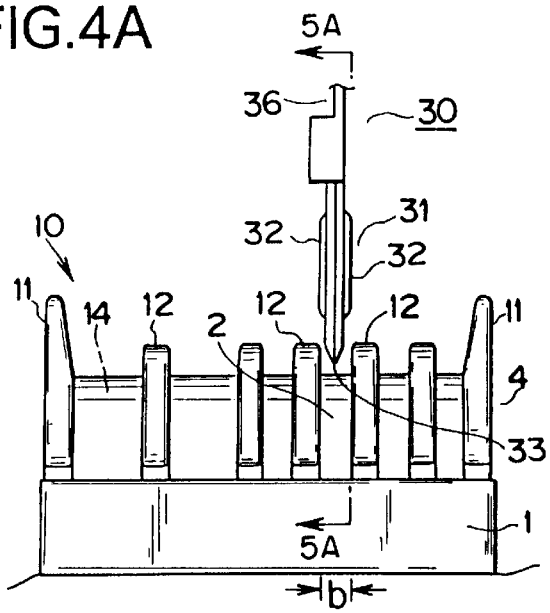
FIGS. 4A to 4C are respectively views illustrating the state of Insertion of the forks of the flat cable connection terminal between the partitions of the terminal holder of the flat cable.
Figure 5A:
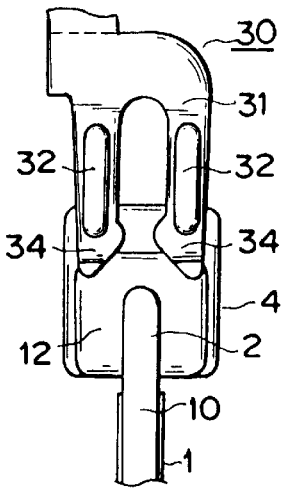
FIGS. 5A to 5C are sectional views along a line A—A in FIGS. 4A to 4C.
Figure 4B:
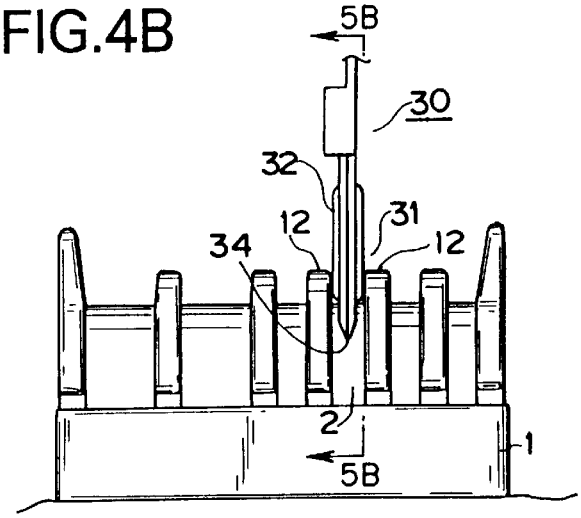
Figure 5B:
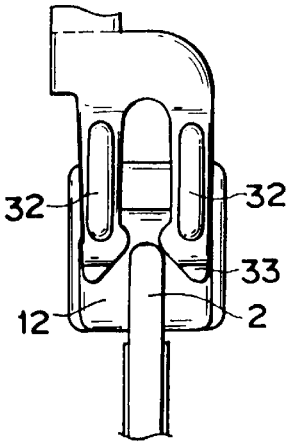
Figure 4C:
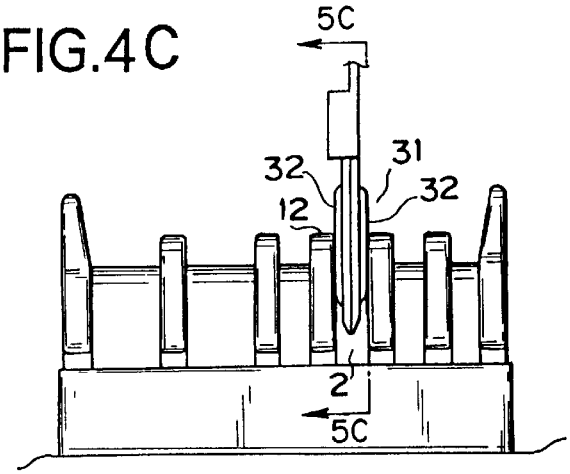
Figure 5C:
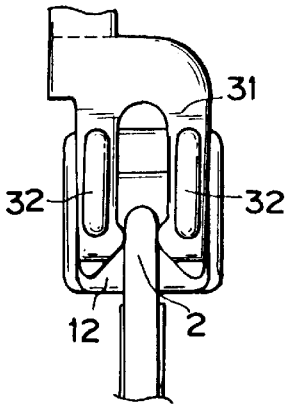

The prongs 34 of the forks 31 are flat, but thick portions (swellings or projections) 32 are formed partially projecting out at the two sides of the bent prongs 34 as illustrated In FIG. 2C. The frontmost ends 32*a* of the thick portions 32 at the slot 35 side, as shown in FIG. 3 and FIG. 4B, are formed so that the frontmost ends 33 of the prongs 34 of the fork 31 will enter between the adjoining partitions 12, 12 or adjoining side walls 11 and partitions 12 of the terminal holder 10 before the contact with the conductor 2 accommodated in the groove 14 of the terminal holder 10. The reason is so that the thick portions 32 first enter between the partitions 12, 12 and serve as guides for smoothly guiding the frontmost ends 33 of the prongs 34, 34 into the groove 14 and, further, the thick portions 32 enable a reduction in the mechanical grip of the conductor 2 by providing an exact amount of the gripping force of the opposing frontmost ends 33, 33 of the facing prongs 34, 34 with the terminal holder 10. If the effective thickness a of the combined thick portions 32 is somewhat smaller than the width b of the groove 14, the prongs 32 of the fork 31 can be easily inserted into the groove 14 over the bent back conductor. However, if the thickness a of the thick portions 32 is made too much smaller than the width b, the fork 31 will move in the groove 14, so the state of connection will not be stable. Of course, if the thickness a of the thick portions 32 is larger than the width b of the groove 14, the fork 31 will not enter into the groove. Accordingly, as illustrated in FIG. 2C and FIG. 3, the effective thickness (height) a between the thick portions 32 of the two surfaces is made substantially the same as, or somewhat smaller than, the interval (or width of the groove 14) b of the adjoining partitions 12, 12 of the terminal holder 10.

The ends of the facing prongs 34 of the fork 31 at the side of the slot 35, as illustrated in FIG. 2C, FIG. 3, and FIGS. 4A to 4C, are convergently inclined toward the frontmost ends 33. The reason is to facilitate the insertion of the frontmost ends 33 front the slot 35 and reduce to a minimum the contact resistance with the flat conductor 2. In other words, if the width of the frontmost ends 33, 33 of the prongs 34, 34 is larger the flat conductor 2 is contacted over a wide area. It is difficult to ensure and maintain a uniform state of connection over a wide area and the contact resistance tends to become greater. However, if the frontmost ends 33 are overly thin, as explained with reference to FIGS. 1A to 1C, the contact area between the frontmost ends 33 of the fork 31 and the conductor 2 becomes extremely small and the electrical resistance tends to become large and, in addition, the state of connection is unstable. Therefore, the thickness of the frontmost ends 33 is made a thickness of an extent enabling sufficiently stable connection with the conductor 2 without an increase in the contact resistance.

Further, near the frontmost ends 33 of the fork 31 are formed wedge-shaped surfaces 33*a* terminating in projections 33*b* projecting out and facing each other across the slot 35. The reason for the formation of the projections 33*b* is that they bite into the conductor 2 somewhat when the fork 31 is inserted over the conductor 2 to establish sufficient electrical connection between the conductor 2 and the fork 31 and make detachment of the fork 31 from the conductor 2 difficult. In particular, the prongs 34 of the flat cable connection terminal are formed of a conductive sheet of metal, for example, a sheet of copper or gold-plated iron, so themselves have elasticity. By using this elasticity and setting the width (interval) c of the spacing of the projections 33*b* facing each other near the front ends 33 of the two prongs 34 facing each other across the slot somewhat smaller than the thickness of the conductor 2 accommodated bent back in the groove of the terminal holder 10, the facing projections 33*b* are pushed apart by the width c to grip the conductor 2. As a result, the fork 31 is firmly affixed to the conductor 2 by the synergistic effect of the springback force of the facing prongs 34 and the cooperating wedge-shaped surfaces 33*a* and projections 33*b*.

The flat connection terminal 30 illustrated in FIG. 2A may be easily produced, for example, by pressing a sheet of metal to make the thick portions 32 project outward and punching the sheet to the shape shown in FIG. 2A. Next, as illustrated in FIG. 2B, this is bent along the line X—X. Accordingly, it is relatively easy and inexpensive to produce the connection terminal.

Below, an explanation will be made of the method of connection of the conductor 2 and the fork 31 of the flat cable connection terminal 30 in an embodiment of the present invention.

The terminal holder 10 illustrated in FIG. 3 is substantially the same as the terminal holder 10 explained with reference to FIGS. 1A to 1C. That is, the terminal holder 10 is formed by an insulator and is provided with partitions 12 between the two side wails 11, 11. Between the adjoining side walls 11 and partitions 12 or the adjoining partitions 12, 12 are defined grooves 14 for accommodating the conductors 2. The width of the grooves 14 is made somewhat larger than the thickness (or width) of the conductors 2.

The flat cable 1 itself is the same as that explained with reference to FIG. 1A. That is, the connection portion 4 of the flat cable 1 is obtained by stripping the insulator 5 of the flat cable 1 to expose the conductors 2. The intervals (slits) 3 between the adjoining conductors 2, 2 are defined by their arrangement. The conductors 2 are usually single strands of flat copper.

Figure 1A:
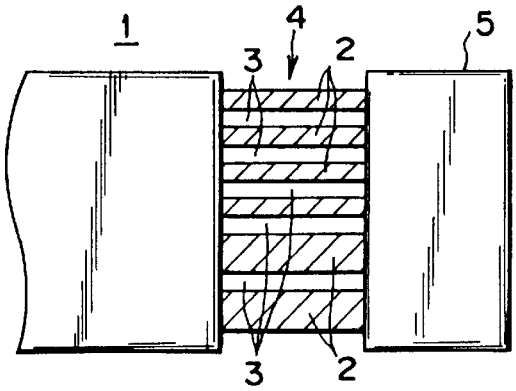
FIG.1A PRIOR ART
FIGS. 1A to 1C are, respectively, a plan view of a connection end of a flat cable in the related art of the present invention, a perspective view of a terminal holder which is attached to the connection end of the flat cable, and a perspective view of the state of insertion of a connection terminal over the terminal holder of the flat cable.
Figure 1B:
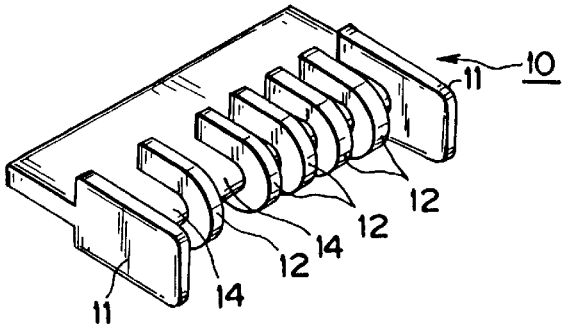
FIG.1B PRIOR ART
Figure 1C:
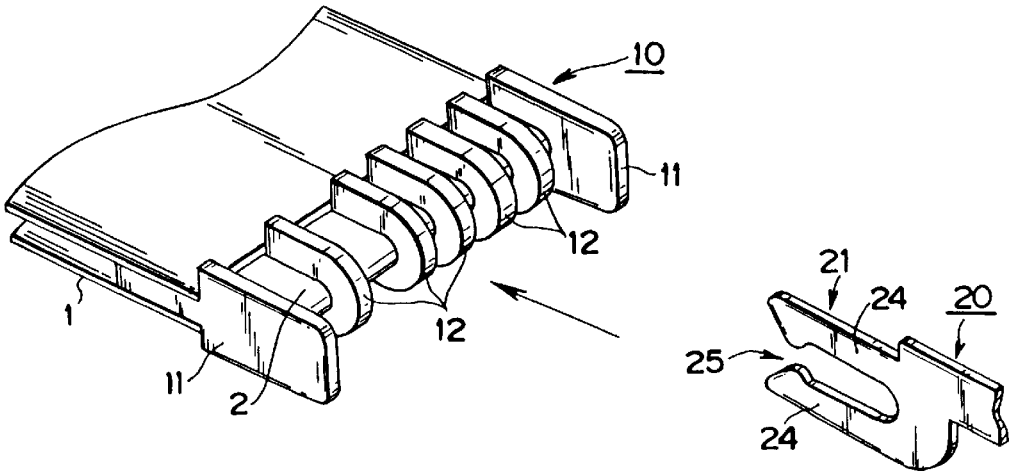
FIG.1C PRIOR ART

FIGS. 4A to 4C and FIGS. 5A to 5C are views of the state of connection of the flat cable connection terminal 30 of the embodiment of the present invention to the terminal holder 10 of the flat cable illustrated in FIG. 1A.

Here, an explanation will be given of a method of connection of a conductor 2 and a fork 31 of a flat cable connection terminal 30 in an embodiment of the present invention.

1. Preparatory Stage

The flat cable 1 illustrated in FIG. 1A, the terminal holder 10 illustrated in FIG. 3, and a flat cable connection terminal 30 partially illustrated in FIG. 2B are prepared.

2. Formation of Connection Portion

The insulator 5 of the connection portion 4 of the end of the flat cable 1 is removed to expose the conductors 2.

3. Attachment of Terminal Holder 10 to Conductors 2 of Flat Cable 1

The exposed conductors 2 of the flat cable 1 are inserted in the grooves 14 of the terminal holder 10, the slits 3 are fixed over the partitions 12, and the flat cable 1 is bent back 180° at the end of the terminal holder 10.

4. Gripping Conductor 2 by Fork 31

A conductor accommodated in a groove 14 of the terminal holder 10 and bent back at the end is gripped by a fork 31 of a flat cable connection terminal 30. That is, the fork 31 is pushed in with the slot 35 facing the conductor 2. When this is done, first, the thick portions 32 abut against the adjoining partitions 12, 12 and serve as guides for the insertion of the forks 31 and thereby establish a mechanical connection between the partitions 12, 12 and the fork 31. Further, if the fork 31 is extended into the groove 14, the conductor 2 enters between the wedges 33*a* and projections 33*b* of the frontmost ends 33, 33 of the opposing prongs 34, 34, the prongs are spread apart against the elastic force and are mechanically affixed to the conductor 2, and an electrical connection is established with the conductor 2. At this stage of the work, the thick portions 32 also enter between the partitions 12, 12 and extend laterally thereacross to strengthen the mechanical connection between the fork 31 and the terminal holder 10. The fork 31 is pushed into the groove 14 until the base (or root) 37 of the fork 31 abuts against the bent back conductor 2.

Due to the above, the connection between the conductor 2 and the fork 31 of the flat cable connection terminal 30 is established.

In the above embodiment, the frontmost ends 33 of the prongs 34 of the fork 31 are laterally convergently tapered, so insertion between the adjoining partitions 12, 12 or adjoining side walls 11 and partitions 12 is easy and stable connection to the conductor 2 is achieved with little contact resistance.

Further, in the present embodiment, since the thick portions 32 of the fork 31 of the flat cable connection terminal 30 are fit between the adjoining partitions 12, 12 or adjoining side walls 11 and partitions 12 at the two sides of the grooves 11 of the terminal holder 10, the mechanical connection between the forks 31 and the partitions 12, 12 is enhanced and the conductor 2 and fork 31 are stably connected without burden on the connection between facing prongs 34, 34 of the fork 31. For example, even if earthquake or other vibration or some tensile force acts on the fork 31 or flat cable 1 or terminal holder 10, the state of connection between the conductor 2 and the fork 31 will remain stable. In addition, since the opposing projections 33*b* near the frontmost ends 33, 33 are pushed apart at the time of connection to the conductor 2, the electrical connection is reliable and the mechanical connection force with the conductor 2 is enhanced.

Note that a wire is connected (crimped) at a crimping portion 36 at the opposite side of the fork 31 of the flat connector connection terminal 30. This wire is connected to an electrical apparatus.

The present invention may be modified in various ways within the range of the above embodiments.

Figure 6:
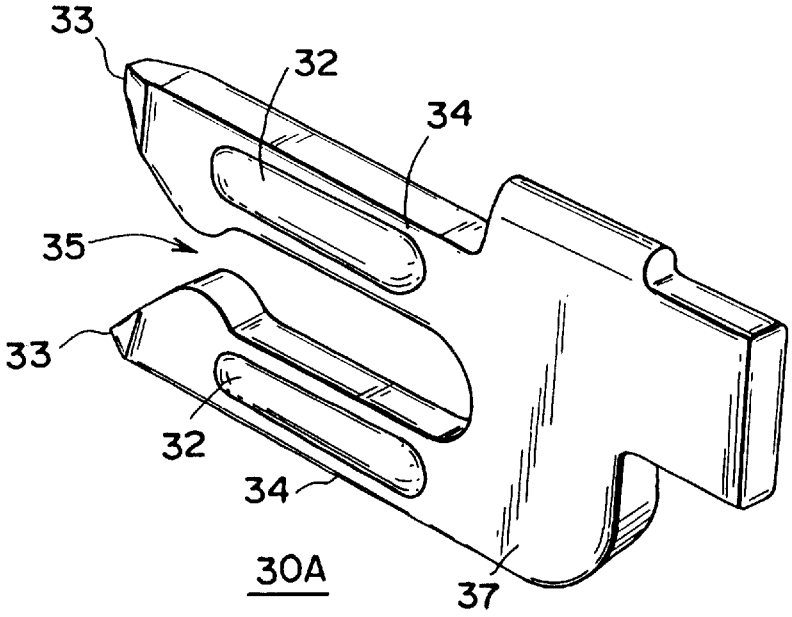
FIG. 6 is a perspective view of a part of the flat cable connection terminal of a second embodiment of the present invention.

For example, the above embodiment shows the case, as illustrated in FIGS. 2A to 2B, in which the prongs 34 having the projecting thick portions 32 are overlaid to comprise the fork 31. However, so long as the shape and the configuration of the flat cable connection terminal 30 are as explained above, it is also possible to form the flat cable connection terminal by a single sheet of conductive metal and not overlay two sheets of conductive metal. That is, as illustrated in FIG. 6, it is possible to form a flat cable connection terminal by a single sheet of conductive metal. The thickness a etc. of the thick portions 32, 32 of the connection terminal 30A illustrated in FIG. 6 are similar to those of the above-mentioned embodiment.

Figure 7:
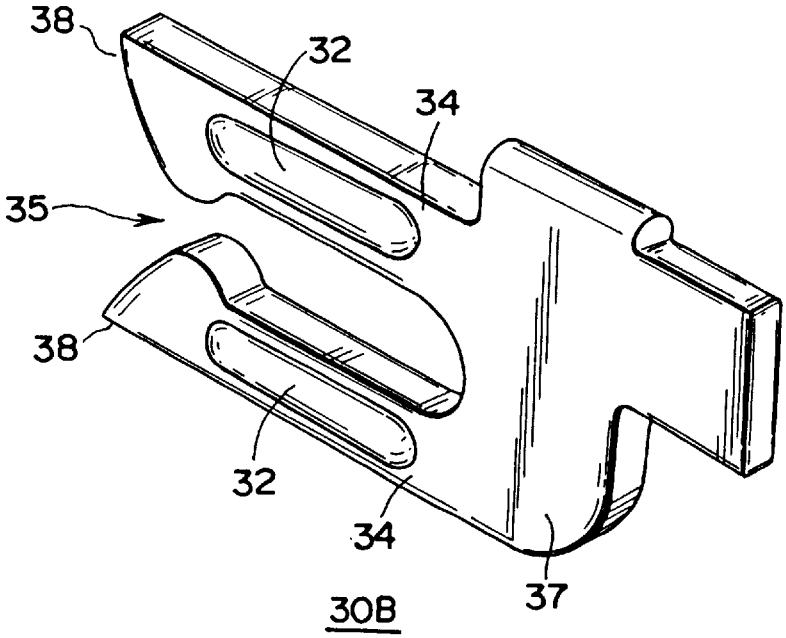
FIG. 7 is a perspective view of a part of the connection terminal of a third embodiment of the present invention.

The connection of the present invention is not limited to the conductor 2 of a flat cable 1. That is, the conductor 2 is not limited to flat, single conductor 2 and may be a twisted conductor of a substantially circular cross-section. Further, the invention is not limited to a flat cable and may similarly connect a conductor of usual cables etc. using the terminal holder 10. However, in the case of a twisted conductor or a conductor with a circular cross-section etc., the connection terminal preferably is one of the shape illustrated in FIG. 7. The connection terminal 30B illustrated in FIG. 7 resembles the connection terminal 30A illustrated in FIG. 6, but the frontmost ends 38 are not made thinner. The prongs 34, 34 extend in the same thickness up to the frontmost ends 38. The reason is that a flat surface is preferable for stably and reliably gripping the top of a round conductor accommodated in a groove 14 of the terminal holder 10.

In the above embodiment, the case is shown in which the interval c between the two wedge-shaped surfaces 33*a* terminating in projections 33*b* facing each other over the slot 35 near the frontmost ends 33, 33 or 38, 38 of the prongs 34, 34 are made somewhat smaller than the width (or effective thickness) of the bent-back conductor 2 and the prongs are pushed apart when the conductor 2 is gripped, but in the present invention the thick portions 32, 32 establish sufficient mechanical connection between the partitions 12, 12 of the terminal holder 10, so it is also possible to make the interval between the two facing projections 33*b* about the same as the width (or effective thickness) of the bent-back conductor 2 to make it an extent in which electrical connection is established.

Conversely, since the two projections 33*b* facing each other are connected electrically and also the mechanical connection force is large, it is possible to eliminate the thick, portions 32, 32 or make them of a lesser lateral extent to restrict large movement in the lateral direction between the partitions 12, 12.

As explained above, according to the present invention, the connection between the conductor and connection terminal is stable and the contacts resistance is low.

Further, according to the present invention, the connection may be made stable without relying on the skill of the worker, the work of connecting the conductor and connection terminal is simple, and the state of connection remains stable over a long period.

Further, the connection terminal of the present invention can be produced relatively easily and at a low cost.

I claim:

1. A connection terminal having a connection portion for gripping two sides of a conductor accommodated in a groove disposed between groove-forming partitions of a terminal holder and bent back at the end of the terminal holder so as to connect to the conductor, said connection portion provided with a fork comprised of two prong portions facing each other across a slot of a size not substantially greater than the effective thickness of the bent back conductor so as to grip the two sides of the conductor bent back in the groove at the end of the terminal holder, and said fork having substantially flat prong portions of a thickness not substantially greater than the width of the conductor, and thick portions projecting laterally out from side surfaces of the flat prongs and having a thickness for insertion in the groove of the terminal holder and closely fitting between the partitions to laterally stabilize the connection portion position on the terminal holder.

2. A connection terminal as set forth in claim 1, wherein front ends of the prongs facing each other across the slot comprising the fork are formed with oppositely inclined surfaces across the slot so as to facilitate insertion over the bent back conductor.

3. A connection terminal as set forth in claim 2, wherein front ends of the prongs facing each other across the slot comprising the fork are formed with the opposed projections so as to press against the conductor.

4. A connection terminal as set forth in claim 3, wherein the interval between the prongs facing each other across the slot comprising the fork are spaced slightly narrower than the effective thickness of the conductor bent back at the terminal holder.

5. A connection terminal as set forth in claim 4, wherein the prongs facing each other across the slot comprising the fork have resiliency in a direction facing each other across the slot.

6. A connection terminal as set forth in claim 1, wherein a portion for connection to a wire is provided at the side of the prongs opposite to the slot.

7. A connection terminal as set forth in claim 1, wherein the conductor is at least one conductor of a flat cable, comprised of a plurality of conductors arranged at predetermined intervals and covered with an insulator, from which part of the insulating covering has been removed to expose the same.

8. A connection terminal as set forth in claim 7, wherein the opposed prongs are formed with surfaces divergently inclined toward the frontmost end for gripping the conductor.

9. A connection terminal as set forth in any one of claims 1 to 8, wherein the connection terminal is formed by bending a single sheet of conductive metal and has a thickness when bent which is not substantially greater than the thickness of the conductor.

10. A connection terminal as set forth in claim 9, wherein projecting portions comprising the thick portions are formed on the single sheet of conductive metal.

11. A connection terminal as set forth in claim 1, wherein the effective lateral thickness of the thick portions of the prongs of the connection terminal is a thickness not substantially greater than the lateral width of the groove of the terminal holder.

12. A connection terminal having a connection portion for gripping two sides of a conductor accommodated in a groove disposed between groove-forming partitions of a terminal holder and bent back at the end of the terminal holder so as to connect to the conductor, the connection portion comprising a fork having two resilient prongs facing each other across a slot of a size not substantially greater than the effective thickness of the bent back conductor so as to grip the two sides of the conductor bent back in the groove at the end of the terminal holder, the lateral thickness of the prongs being formed not substantially greater than the lateral width of the conductor, thick portions projecting laterally outward from side surfaces of the prongs and defining a thickness for insertion in the grooves of the terminal holder and closely fitting between the partitions to laterally stabilize the position of the connection portion on the terminal holder, the prongs each having wedge shaped surfaces to facilitate insertion of said fork on said bent back conductor, said wedge shaped surfaces terminating in projections disposed at oppositely spaced locations across the slot and the interval between the projections being set smaller than the effective thickness of the conductor to be gripped, and the conductor being effectively connected by the resiliency of the facing prongs.

13. A method of connection of a flat cable comprised of a plurality of conductors arranged horizontally at predetermined intervals and covered with an insulator, comprising the steps of, removing part of the insulator to expose the conductors and form a connection portion, disposing the exposed conductors of the connection portion of the flat cable in grooves of an insulating terminal holder having a plurality of groove-forming partitions having widths corresponding to intervals between adjacent conductors of the flat cable and bending back the flat cable at the end of the terminal holder, and gripping the two sides of the bent back conductors of the flat cable by forks of a connection terminal in which the forks comprise pairs of conductive prongs formed so as to grip the two sides of the conductor of the flat cable accommodated bent back in the groove of the terminal holder, wherein, said prongs of said cable connection terminals have an effective lateral thickness which is produced by thick portions projecting laterally outward from opposite side surfaces of the prongs to correspond substantially to the width of an associated groove of the terminal holder and the forks are fit over the two sides of the conductors of the flat cable.

* * * * *